US006179694B1

(12) United States Patent
Quek

(10) Patent No.: US 6,179,694 B1
(45) Date of Patent: Jan. 30, 2001

(54) EXTENDED GUIDE RINGS WITH BUILT-IN SLURRY SUPPLY LINE

(75) Inventor: Sebastian Ser Wee Quek, Singapore (SG)

(73) Assignees: Chartered Semiconductor Manufacturing Ltd.; Silicon Manufacturing Partners Pte Ltd., both of Singapore (SG)

( * ) Notice: Under 35 U.S.C. 154(b), the term of this patent shall be extended for 0 days.

(21) Appl. No.: 09/395,285

(22) Filed: Sep. 13, 1999

(51) Int. Cl.[7] ..... B24B 29/00

(52) U.S. Cl. ..... 451/286; 451/288; 451/285; 451/60

(58) Field of Search ..... 451/285–289, 451/290, 398, 60, 41, 56

(56) References Cited

U.S. PATENT DOCUMENTS

| | | | | |
|---|---|---|---|---|
| 5,476,414 | * | 12/1995 | Hirose et al. | 451/288 |
| 5,569,062 | * | 10/1996 | Karlsrud | 451/285 |
| 5,584,751 | * | 12/1996 | Kobayashi et al. | 451/288 |
| 5,635,083 | | 6/1997 | Breivogel et al. . | |
| 5,785,584 | | 7/1998 | Marmillion et al. . | |
| 5,795,215 | | 8/1998 | Guthrie et al. . | |
| 5,851,140 | * | 12/1998 | Barns et al. | 451/288 |
| 5,876,271 | | 3/1999 | Oliver . | |
| 5,876,273 | | 3/1999 | Yano et al. . | |
| 5,902,173 | * | 5/1999 | Tanaka | 451/288 |
| 6,059,638 | * | 5/2000 | Crevasse et al. | 451/41 |

* cited by examiner

*Primary Examiner*—David A. Scherbel
*Assistant Examiner*—Lee Wilson
(74) *Attorney, Agent, or Firm*—George O. Saile; Rosemary L. S. Pike

(57) ABSTRACT

The purpose of the present invention is to provide a carrier mechanism, that polishes the wafer equally across the wafer surface by circumventing the problems caused by "pad rebound" or "waving phenomenon" during polishing. In doing this, pressure against the pad at the edge of the wafer will be equal to that at the center resulting in uniform pressure on the wafer during polishing and even planarization of thin film semiconductor material. One embodiment of the present invention uses a wider extension ring causing the pressure stress concentration point to occur just inside the outer edge of the extension ring and away from the wafer. This allows for constant pressure application to the surface of the wafer and results in uniform material removal across the wafer surface. A second embodiment of the present invention uses a wider extension ring having a slurry channel and a plurality of passageways. Slurry is dispensed into the channel and is directed to the polishing pad and wafer through the passageways. This feature allows slurry to be applied more directly to the wafer, resulting in improved wetting of the polishing pad and reduction in slurry usage. Again, with the wider extension ring, the pressure stress concentration point on the polishing pad occurs under the extension ring and away from the wafer resulting in uniform material removal across the wafer surface.

17 Claims, 3 Drawing Sheets

EXTENDED GUIDE RINGS WITH BUILT-IN SLURRY SUPPLY LINE

BACKGROUND OF THE INVENTION (1) Field of the Invention

The invention generally relates to a semiconductor wafer carrier and, more particularly to methods of improving the apparatus used in holding a semiconductor wafer during a chemical mechanical polishing (CMP) process.

(2) Description of Prior Art

Semiconductor fabrication often uses a combination of chemical and mechanical polishing to reduce the thickness and planarize a thin film coating on a wafer. Typically, the wafer is placed in a polishing head and makes contact with a rotating polishing pad having a slurry applied thereto. Often the polishing head holding the wafer also rotates making the planarization process more uniform.

FIG. 1 illustrates a cross section of the current art for the polishing process. The wafer 14 is held in place laterally by the extension ring 20. To facilitate thin film planarization, uniform pressure is applied mechanically from above to the carrier 18 holding the wafer 14 firmly against the polishing pad 12. To aid in maintaining uniform pressure to the wafer 14, a thin backing film 16 is usually attached to the carrier 18. The polishing table 10 and polishing pad 12 are rotated at a set speed, while often, the carrier 18, backing film 16, and wafer 14 rotate at a second set speed. During automated loading and unloading, the wafer is held onto the carrier by vacuum pressure via passages 22.

Using the current methods of CMP to polish a wafer, less material is removed from the edge of the wafer than from the center. This is due to a phenomenon known as "pad rebound" or "waving phenomenon" and results in non-functioning devices on the wafer edge. FIG. 2*a* shows a magnified cross section of the edge of the wafer 14, the polishing pad 12, the carrier 18, the backing film 16 and extension ring 20. When the wafer 14 is pressed downward onto the pad 12, a stress concentration 38 occurs just inside the outer edge of the extension ring 20 as the pad 12 is pressed against the extension ring 20 and wafer 30. This results in the pad 12 rebounding away from the extension ring 20 and wafer 14. This is illustrated by the exaggerated dip 39 in the pad 12. FIG. 2*b* shows graphically the result of the pad rebound phenomenon. The extension ring is typically 3 to 4 mm wide. A portion of the pad rebound (~3 to 4 mm from the edge of the extension ring 12) occurs under the extension ring (region 32). Because of the pad rebound, material removal rate at the interface 30 between the ring and wafer is approximately at a minimum. The material removal rate increases toward the center of the wafer 14, and becomes constant at ~6 to 7 mm (region 37) inside the edge of the extension ring (2 to 4 mm from the edge of the wafer). Unfortunately, the edge of the wafer (region 34) has a higher material removal rate and is therefore unusable.

Other approaches attempt to address problems with pad rebound during polishing. U.S. Pat. No. 5,795,215 to Guthrie et al. teaches a method using different pressures applied to the carrier and extension ring. U.S. Pat. No. 5,876,273 to Yano et al teaches a method using a pressure-absorbing member between the carrier and extension ring. This member allows movement of the extension ring with respect to the carrier while maintaining uniform pressure on the wafer. Another embodiment has a circular plate surrounding the wafer. U.S. Pat. No. 5,785,584 to Marmillion et al teaches a method utilizing a raised section on the polishing pad. U.S. Pat. No. 5,635,083 to Breivogel et al teaches a method whereby an air pillow under the wafer holds it flat against the polishing pad. It also utilizes different pressures on the carrier and wear ring to minimize pad rebounding. U.S. Pat. No. 5,876,271 to Oliver teaches a method whereby slurry is applied to the wafer surface though a plurality of holes in the surface of the polishing pad. U.S. Pat. No. 5,851,140 to Barns et al. teaches a method using a flexible carrier plate providing an air pillow that maintains uniform pressure on the wafer during CMP.

SUMMARY OF THE INVENTION

A principal object of the present invention is to provide a carrier mechanism which polishes the wafer equally across the wafer surface by circumventing the problems caused by "pad rebound" or "waving phenomenon" during polishing.

Another object of the present invention is to equalize the pressure against the pad across the entire surface of the wafer, resulting in even planarization of thin film semiconductor material.

Yet another object of the present invention is to provide an improved mechanism for positioning semiconductor wafers during polishing.

Another object of the present invention is the reduction in slurry usage during the polishing process.

These objects are achieved by two improvements of the wafer carrier head over the prior art. The first improvement uses a wider extension ring. This results in the pad rebound phenomenon occurring only under the extension ring, allowing the applied pressure to be uniform across the wafer. The second improvement directs the polishing slurry to the pad/wafer interface through passageways in the extension ring. This alleviates problems of getting slurry to contact the wafer while using the wider extension ring, and results in a reduction in slurry usage.

BRIEF DESCRIPTION OF THE DRAWINGS

In the accompanying drawings forming a material part of this description, there is shown.

DESCRIPTION OF THE PREFERRED EMBODIMENTS

The purpose of the present invention is to provide a carrier mechanism that polishes the wafer equally across the wafer surface by circumventing the problems caused by "pad rebound" or "waving phenomenon" during polishing. In doing this, pressure against the pad at the edge of the wafer will be equal to that at the center resulting in uniform pressure on the wafer during polishing and even planarization of thin film semiconductor material.

Figure 1:
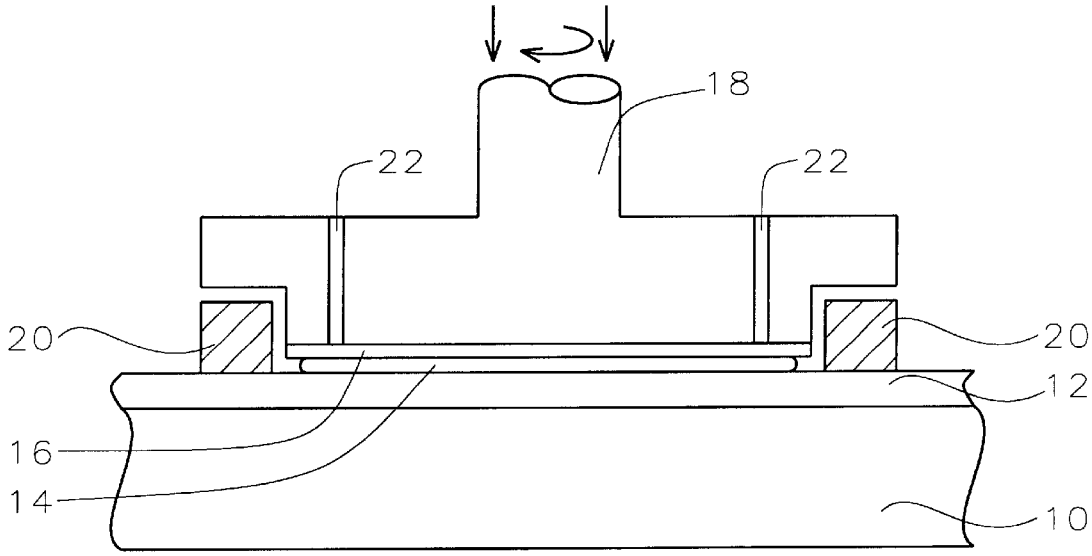
FIG. 1 Prior Art
FIGS. 1 schematically illustrates in cross-section a schematic representation of prior art in CMP showing a typical carrier head assembly.
Figure 2A:
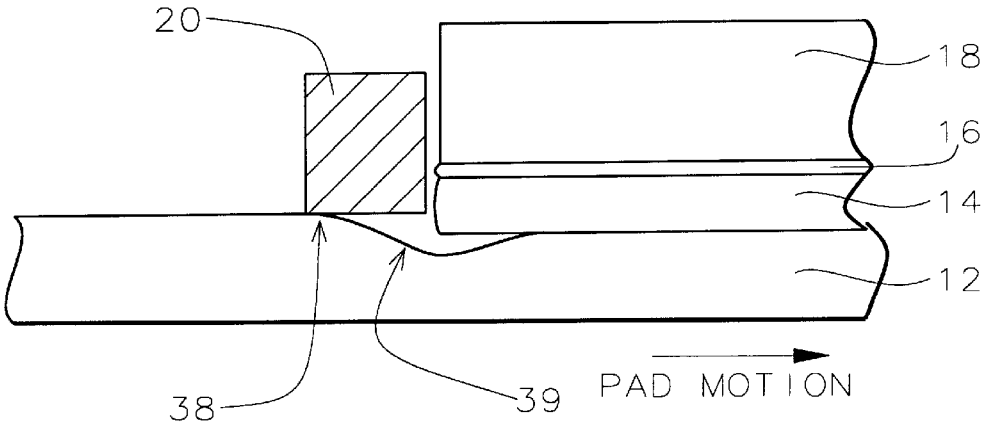
FIG. 2A Prior Art
FIG. 2*a* illustrates the problem of "pad rebound" or "waving phenomenon" using prior art in CMP.
Figure 2B:
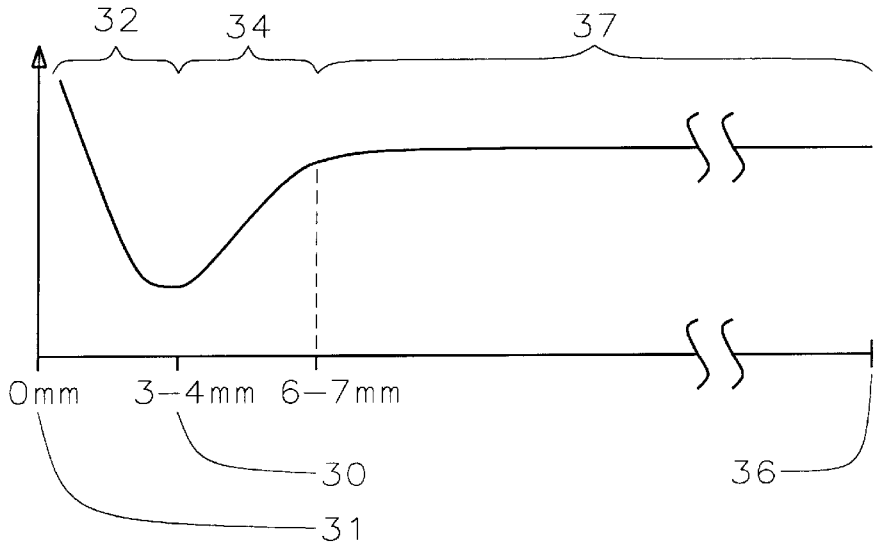
FIG. 2B Prior Art
FIG. 2*b* supports FIG. 2*a* by graphically presenting the material removal rate vs. distance from the outer edge of the extension ring.
Figure 3:
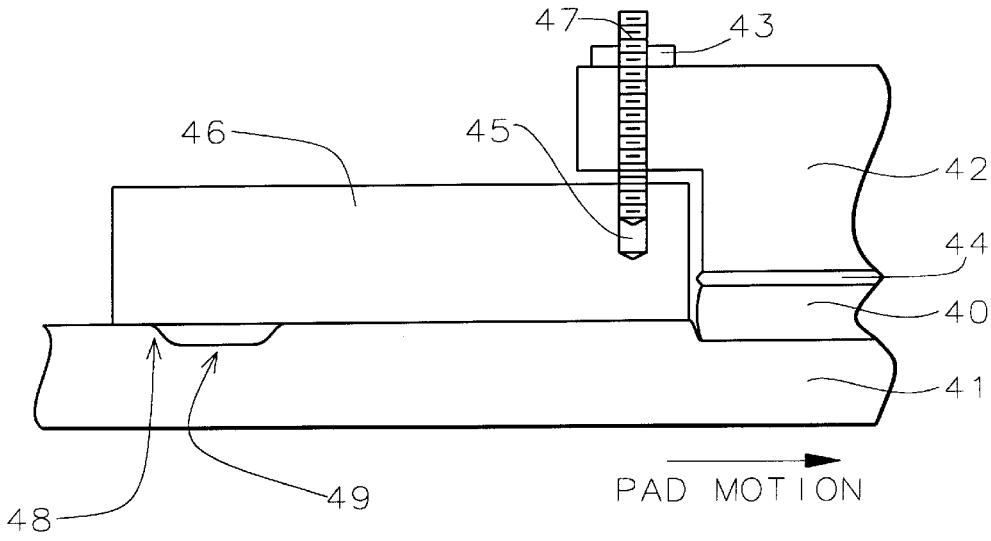
FIG. 3 shows in cross-section the carrier head assembly of an embodiment of the present invention using a wider extension ring.

Referring now more particularly to FIG. 3, there is shown one embodiment of the present invention. FIG. 3 shows a cross section of a portion of a carrier using a wider extension ring 46. The extension ring 46 is secured to the carrier 42. One method for securing the extension ring 46 to the carrier 42 is shown in FIG. 3. It uses a plurality of hex nuts 43 screwed onto stubs 47 threaded into blind holes 45 in the extension ring 46. The carrier 42 presses the wafer 40 to the pad 41 though a backing film 44. The pressure stress concentration point 48 still occurs just inside the outer edge of the extension ring 46. Due to the additional width of the extension ring 46, the rebound dip 49 in the pad 41 occurs only under the extension ring 46 and not under the wafer 40. This allows for constant pressure application to the surface of the wafer 40, resulting in uniform material removal across its surface. The width of the extension ring 46 is not critical, except that it be wide enough so that the pad rebound 49 does not occur under the wafer 40. A minimum extension ring 46 width would be more than one inch wide, and typically 26 to 52 mm.

Figure 4A:
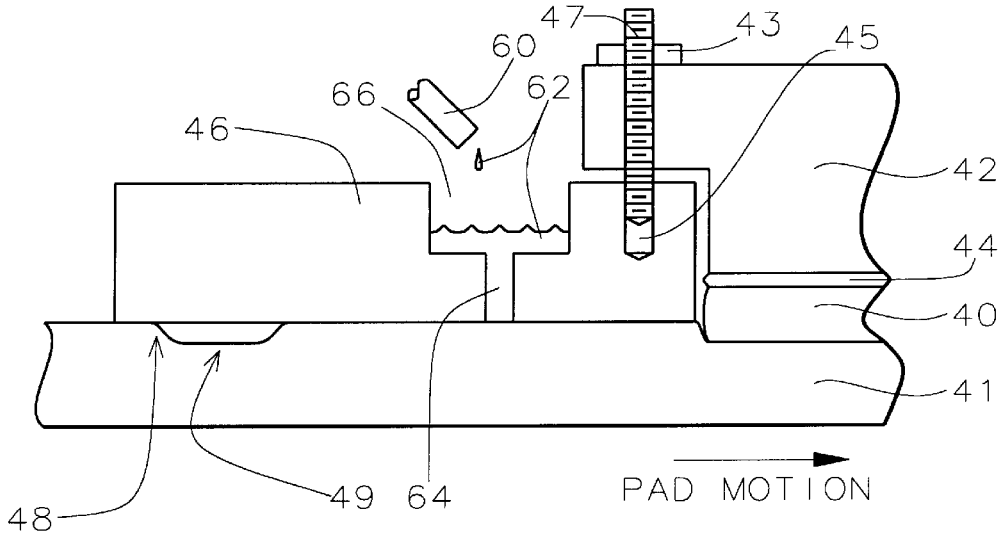
FIG. 4*a* shows in cross-section the carrier head assembly of an embodiment of the present invention with a wider extension ring, a slurry supply line, and openings in the extension ring that allow slurry to reach the wafer.
Figure 4B:
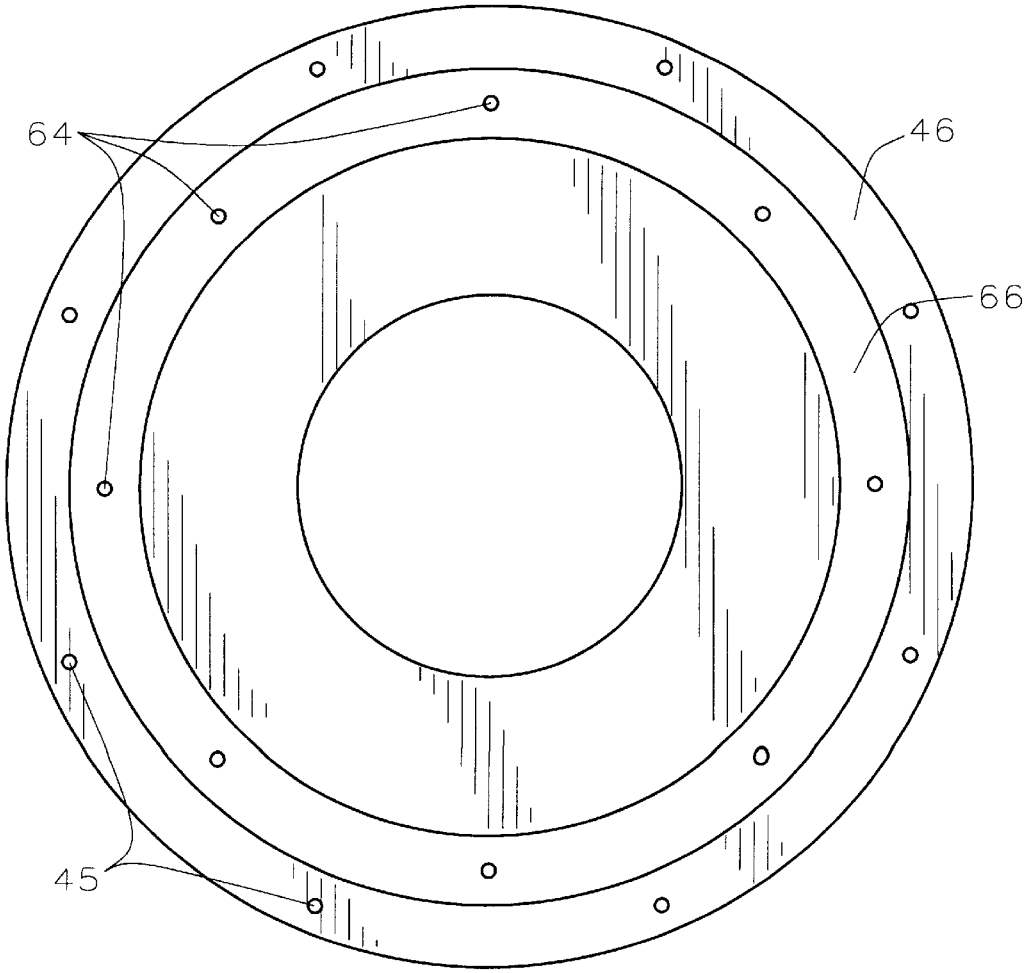
FIG. 4*b* shows a top view of the extension ring with openings to allow slurry to reach the pad and wafer.

Referring now more particularly to FIGS. 4*a* and 4*b*, there is shown a second embodiment of the present invention. FIG. 4*a* shows a cross section of a portion of a carrier using a wider extension ring 46 and incorporates a slurry channel 66 and a plurality of passageways 64. Again, the extension ring 46 is secured to the carrier 42. FIG. 4*a* shows an example of the attachment method using a plurality of hex nuts 43 screwed onto stubs 47 threaded into blind holes 45 in the extension ring 46. The carrier 42 presses the wafer 40 to the pad 41 though a backing film 44 and the pressure stress concentration point 48 occurs just inside the outer edge of the extension ring 46. Also, the rebound dip 49 in the pad 41 occurs only under the extension ring 46 and makes the pressure across the wafer 40 uniform. The addition of the slurry channel 66, and passageways 64, permit slurry 62 to be applied more directly to the wafer 40. Slurry 62 is supplied through a fixed spigot 60 to the channel 66. This feature improves the wetting of the polishing pad 41 and reduces the slurry 62 usage. Again, the extension ring 46 width is not critical, except that it be wide enough so that the pad rebound 49 does not occur under the wafer 40. A minimum extension ring 46 width would be typically 26 to 52 mm. The size of the slurry channel 66 is not critical. The slurry passageways 64 are located at the bottom of the channel 66, and may vary in both number and in shape. FIG. 4*b* shows a top view of the extension ring 46, including the channel 66, the plurality of slurry passageways 64, and the optional threaded blind holes 45 used in one method of securing the carrier (not shown) and extension ring 46.

The carrier mechanism of the present invention polishes a wafer equally across the wafer surface by circumventing the problems caused by "pad rebound" or "waving phenomenon" during polishing. The wide extension ring of the invention serves to equalize the pressure against the pad across the entire surface of the wafer by confining the "pad rebound" to the area beneath the wide extension ring. The problem of getting slurry to the pad/wafer interface while using a wide extension ring is resolved by the presence of slurry passageways within the extension ring. This feature also limits excess slurry usage.

While the invention has been particularly shown and described with reference to the preferred embodiments thereof, it will be understood by those skilled in the art that various changes in form and details may be made without departing from the spirit and scope of the invention.

What is claimed is:

1. A carrier head for chemical mechanical polishing comprising:

a carrier to press a wafer against a polishing pad containing a polishing slurry; and a wide extension ring secured to said carrier to hold said wafer beneath said carrier wherein said extension ring has a minimum width of 26 mm.

2. The carrier head according to claim 1 wherein said carrier has a resilient backing film affixed to a lower surface of said carrier.

3. The carrier head according to claim 1 further comprising means for securing said extension ring to said carrier.

4. The carrier head according to claim 3 wherein said means comprises a plurality of stubs threaded into blind threaded holes in said extension ring wherein said extension ring is secured to said carrier by a plurality of hex nuts on said stubs above said carrier.

5. A carrier head for chemical mechanical polishing comprising:

a carrier to press a wafer against a polishing pad containing a polishing slurry; and a wide extension ring of width not less than 26 mm secured to said carrier to hold said wafer beneath said carrier and to cause rebound in said polishing pad to occur below said extension ring and not below said wafer.

6. The carrier head according to claim 5 wherein said carrier has a resilient backing film affixed to the lower surface of said carrier.

7. The carrier head according to claim 5 further comprising means for securing said extension ring to said carrier.

8. The carrier head according to claim 7 wherein said means comprises a plurality of stubs threaded into blind threaded holes in said extension ring wherein said extension ring is secured to said carrier by a plurality of hex nuts on said stubs above said carrier.

9. A carrier head for chemical mechanical polishing comprising:

a carrier to press a wafer against a polishing pad containing a polishing slurry;

a wide extension ring secured to said carrier to hold said wafer beneath said carrier;

a channel in the top surface of said extension ring;

a plurality of openings from the bottom of said channel to the underside of said extension ring; and a fixed slurry supply line positioned above said channel whereby said polishing slurry may be dispensed into said channel and flow through said openings onto said polishing pad.

10. The carrier head according to claim 9 wherein said carrier has a resilient carrier film affixed to the lower surface of said carrier.

11. The carrier head according to claim 9 wherein said extension ring has a minimum width of 26 mm.

12. The carrier head according to claim 9 further comprising means for securing said extension ring to said carrier.

13. The carrier head according to claim 12 wherein said means comprises a plurality of stubs threaded into blind threaded holes in said extension ring wherein said extension ring is secured to said carrier by a plurality of hex nuts on said stubs above said carrier.

14. A carrier head for chemical mechanical polishing comprising:

a carrier to press a wafer against a polishing pad containing a polishing slurry;

a wide extension ring of width not less than 26 mm secured to said carrier to hold said wafer beneath said carrier and to cause rebound in said polishing pad to occur below said extension ring and not below said wafer;

a channel in the top surface of said extension ring;

a plurality of openings from the bottom of said channel to the underside of said extension ring; and a fixed slurry supply line positioned above said channel whereby said polishing slurry may be dispensed into said channel and flow through said openings onto said polishing pad.

15. The carrier head according to claim 14 wherein said carrier has a resilient carrier film affixed to the lower surface of said carrier.

16. The carrier head according to claim 14 further comprising means for securing said extension ring to said carrier.

17. The carrier head according to claim 16 wherein said means comprises a plurality of stubs threaded into blind threaded holes in said extension ring wherein said extension ring is secured to said carrier by a plurality of hex nuts on said stubs above said carrier.

* * * * *